United States Patent [19]

Laauwe

[11] Patent Number: 4,747,518

[45] Date of Patent: May 31, 1988

[54] SQUEEZE BOTTLE SELF-CLOSING AND VENTING DISPENSING VALVE

[76] Inventor: Robert H. Laauwe, 237 Green Ridge Rd., Franklin Lakes, N.J. 07417

[21] Appl. No.: 936,848

[22] Filed: Dec. 2, 1986

[51] Int. Cl.[4] ..... B05B 11/04; B65D 47/32

[52] U.S. Cl. ..... 222/153; 215/307; 222/213; 222/494; 222/497

[58] Field of Search ..... 222/153, 212, 213, 491–497, 222/481, 481.5, 482, 484, 487, 499, 521–525, 499; 215/307; 220/366

[56] References Cited

U.S. PATENT DOCUMENTS

| | | | |
|---|---|---|---|
| 2,711,271 | 6/1955 | Schlicksupp | 222/497 X |
| 3,149,757 | 9/1964 | Safianoff | 222/153 |
| 3,739,941 | 6/1973 | Ostrwosky et al. | 222/153 |
| 4,162,746 | 7/1979 | Anderson et al. | 222/153 |
| 4,163,500 | 8/1979 | Gunne et al. | 215/307 X |
| 4,226,342 | 10/1980 | Laauwe | 222/494 |
| 4,474,314 | 10/1984 | Roggenburg, Jr. | 222/494 |
| 4,625,899 | 12/1986 | Stull | 222/521 |

*Primary Examiner*—Kevin P. Shaver
*Attorney, Agent, or Firm*—Kenyon & Kenyon

[57] ABSTRACT

A dispensing device for a squeeze bottle has an internal continuously circular vent valve seat. A continuously circular elastic vent valve has one side seating on the seat and an opposite side exposed to the inside of the device. The device has a self-closing dispensing valve which opens upon squeezing the bottle. The device has a lock to prevent unintentional opening of the dispensing valve.

1 Claim, 3 Drawing Sheets

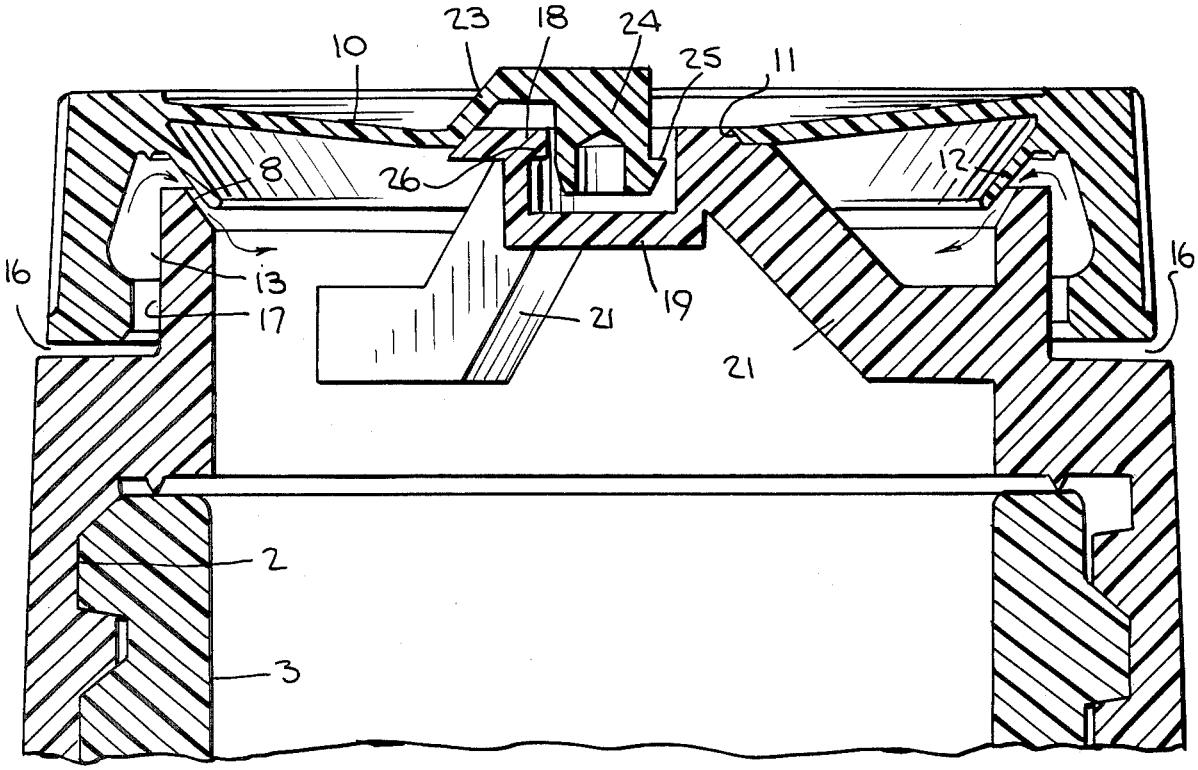
Fig. 2.
Fig. 3.
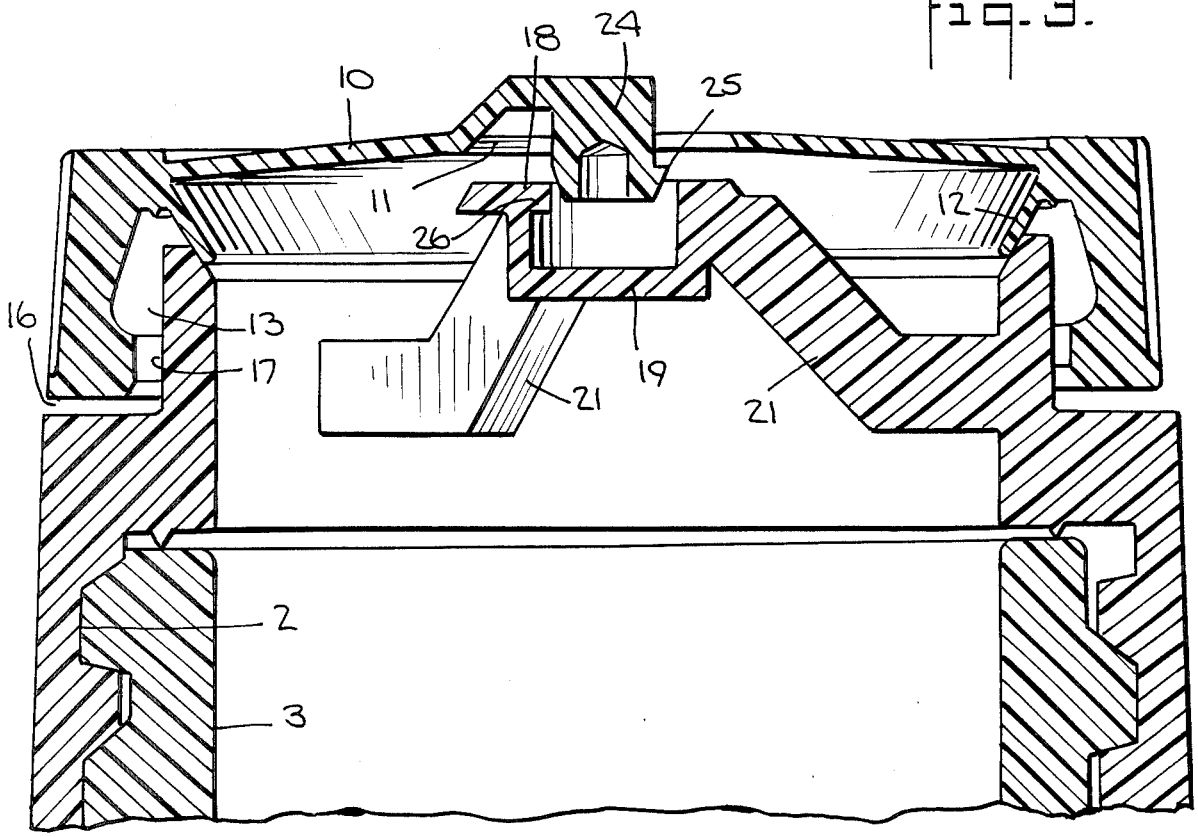

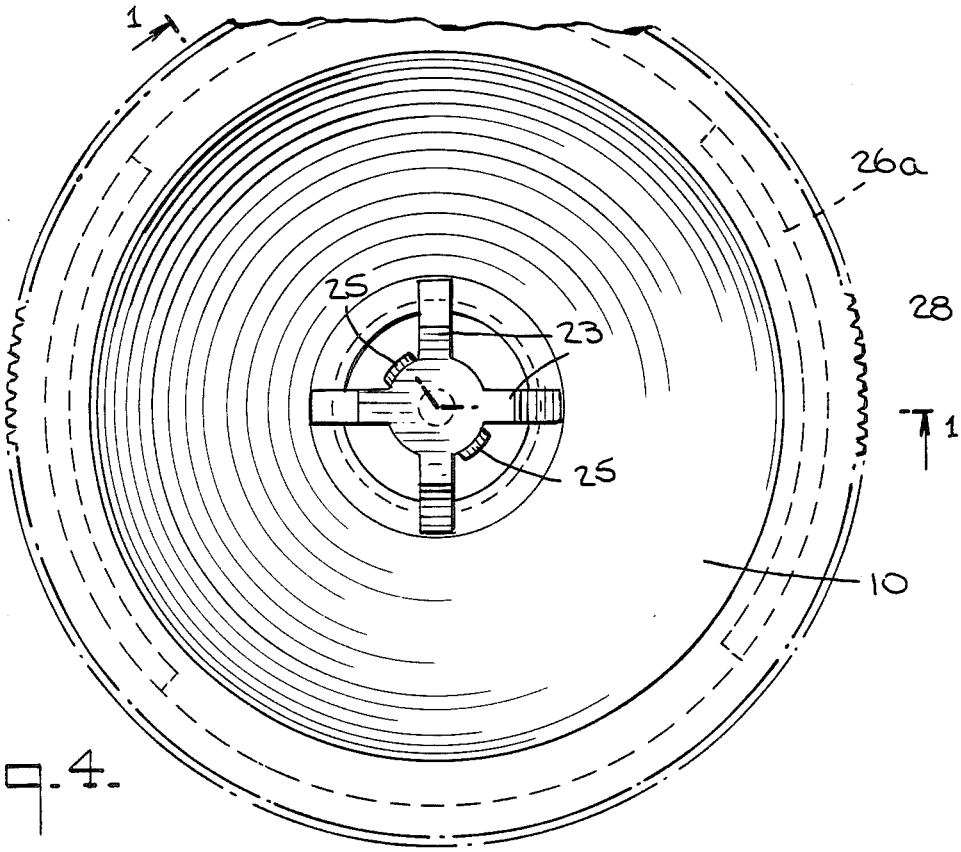
Fig. 4.
Fig. 5.
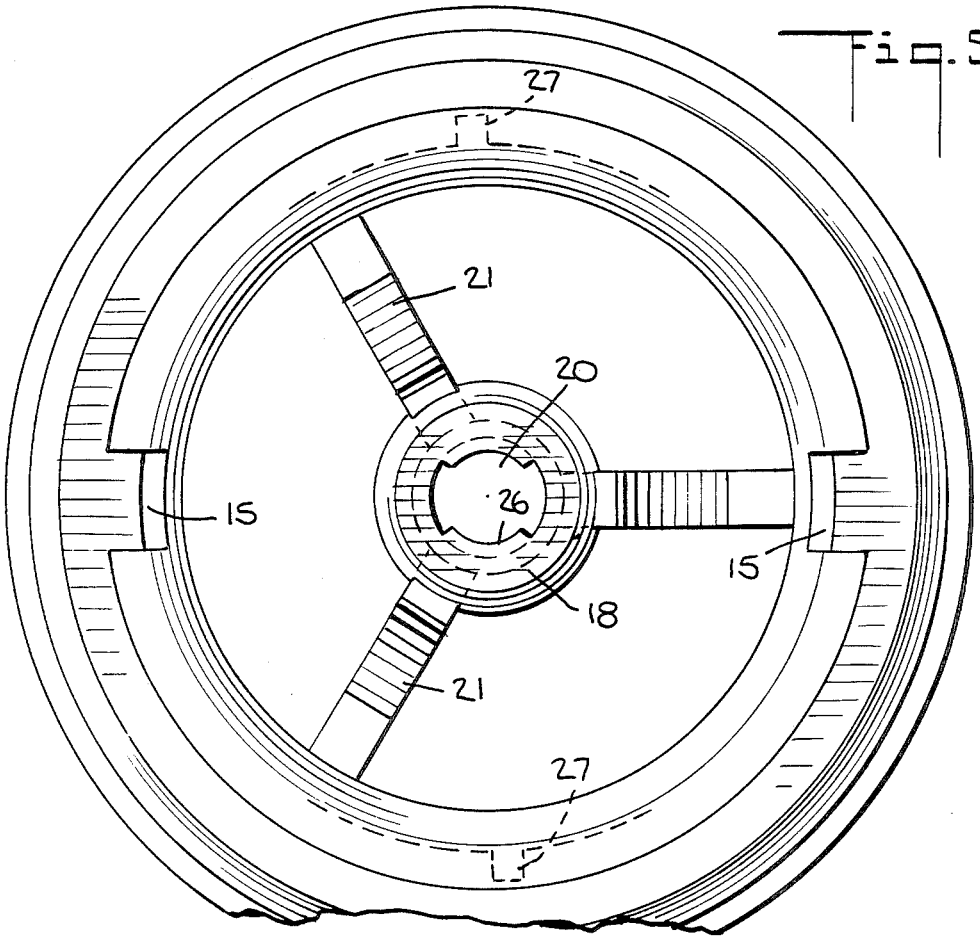

SQUEEZE BOTTLE SELF-CLOSING AND VENTING DISPENSING VALVE

This invention relates to squeeze bottle self-closing and venting dispensing valves.

In normal use, such a valve is screwed on the usual threaded squeeze bottle neck, the bottle containing a viscous product such as liquid soap. When the bottle is squeezed, the pressure of the product opens the valve and when the bottle is released from squeezing, the valve should vent so as to admit air into the bottle and permit the bottle to spring back to its original shape. The bottle is made of elastic plastic.

An example of such a valve is disclosed by the Laauwe U.S. Pat. No. 4,226,342 which issued on an application filed Dec. 15, 1978.

This patented valve does not always vent satisfactorily, and although it provides a positive shut-off, it requires an inner seal in the form of a disc placed between the valve and the bottle neck to insure against leakage by rough handling during shipment. Prior to first use, the user must unscrew the valve, remove and discard the seal, and rescrew the valve on the bottle neck. When the valve is unscrewed, the seal sometimes sticks inside the cap where the seal is virtually invisable, the user then rescrewing the valve on the bottle neck and rendering the valve and bottle inoperative. This has led to customer dissatisfaction.

The object of the present invention is to improve on this kind of valve by providing a way to positively lock the valve closed for shipment while at the same time permitting the valve to be easily reopened by the user and reclosed and locked whenever desired. A further object is to provide such a valve with a more reliable venting valve.

Briefly summarized, the present invention is a dispensing valve formed by a base and a cap which is connected to the base, these two parts each being injection molded from plastic such as is commonly used.

The base forms a cylindrical wall having a lower portion internally reduced in thickness and fitting over the bottle neck and an upper portion externally reduced in thickness and having a top forming an internally beveled rim forming a vent valve seat. This seat is circular and coextensive with the upper portion of the cylindrical wall. The cap forms a depending cylindrical flange surrounding and connected to the upper portion of the cylindrical wall of the base. This cap has a closed top so that it functions as a closure for the bottle, the cap's closed top forming a central dispensing hole. To form a self-closing valve, the closed top is made in the form of a flexible diaphragm and the base has radially inwardly extending spokes on which an annular valve head is supported. The dispensing hole and the valve head have inter-mating conical peripheries and the diaphragm normally presses these peripheries together to provide a positive shut-off. To provide venting, the depending flange of the cap forms a circular elastic vent valve extending angularly inwardly with an inverted conical shape with an outside coextensive normally with and seated on the vent valve seat. The dispensing valve forms a vent passageway connecting with at least a portion of the inside of the vent valve and with the outside of the dispensing valve.

The cap is rotative on the base with the circular elastic vent valve sliding on the circular vent valve seat with the previously mentioned portion of the outside of the vent valve always exposed to the outside of the dispensing valve. Internal pressure on the inside moves the diaphragm upwardly and separates the conical peripheries so as to open the dispensing hole.

To lock the dispensing valve against actuation, the valve head providing one of the conical peripheries, is formed by the periphery of an inverted cup which is immovable because it is fixed by the spokes to the base. This cup has a mouth forming one element of a bayonet joint. The outside, or top, of the diaphragm is fixed to a bracket from which a male element of the joint depends into the cup's mouth. Rotation of the cap on the base makes this joint connect and disconnect. When the joint is connected, the diaphragm is locked down and the need for the previously mentioned inner seal disc is eliminated.

A specific example of this new dispensing valve is illustrated by the accompanying drawings, in which:

FIG. 2 is the same as FIG. 1, but shows the self-closing valve unlocked and the dispensing valve venting.

FIG. 3 is again like FIG. 1, but shows the self-closing valve open and the vent valve closed.

FIG. 4 is a top view of the cap; and

FIG. 5 is a top view of the base.

Figure 1:
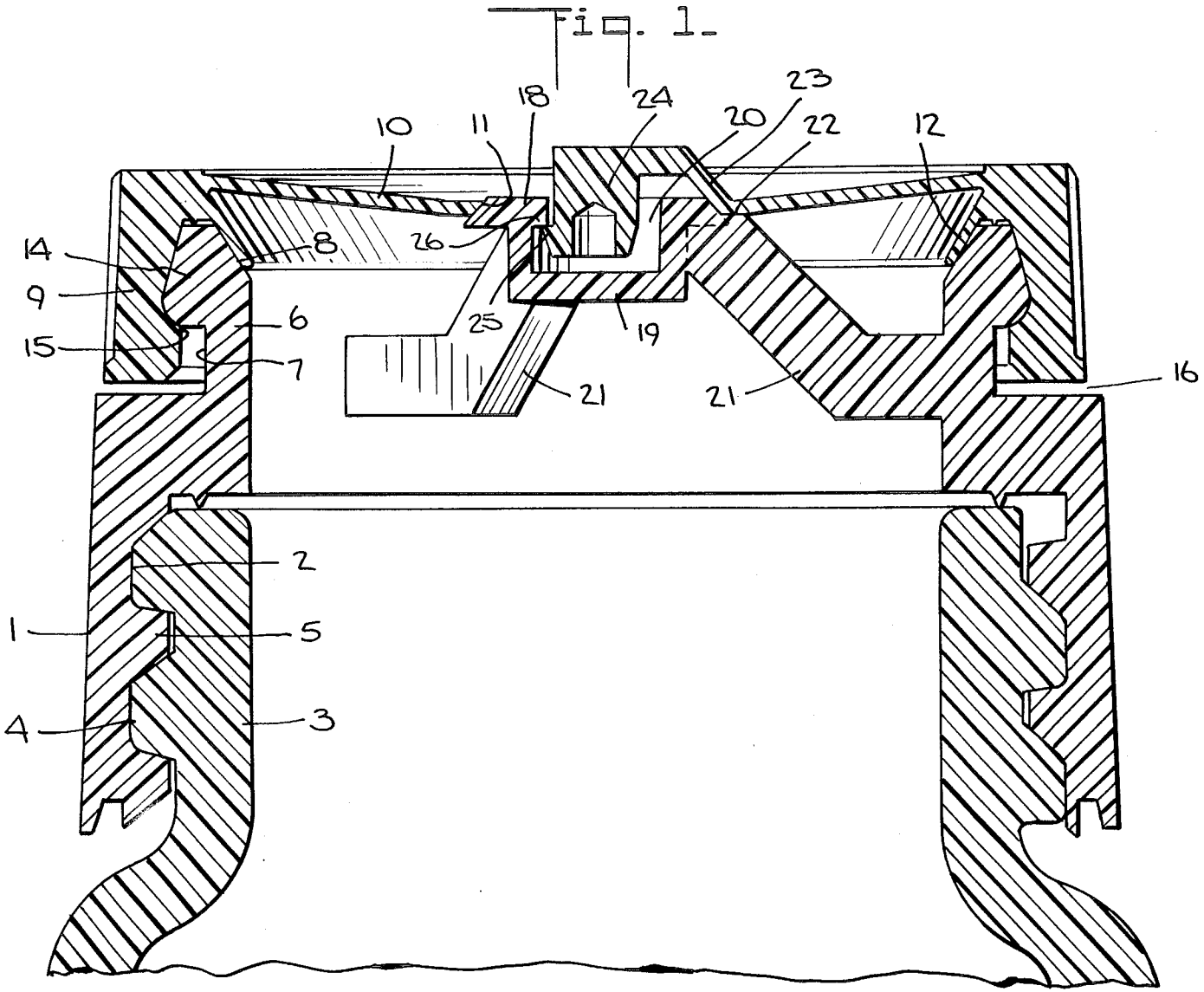
FIG. 1 is a vertical section on an enlarged scale showing the construction of the new dispensing valve, with the self-closing valve locked closed.

These drawings show the new valve with its base and cap connected together. The base forms a cylindrical wall having a lower portion 1 internally reduced in thickness as at 2 and fitting over the neck 3 of a squeeze bottle. The neck is shown with its usual external screw thread 4, the wall's lower portion 1 being internally threaded at 5 for screw threaded engagement with the bottle neck. The wall formed by the base has an upper portion 6 externally reduced in thickness as at 7 and at its top forms an internally beveled rim forming the vent valve seat 8. This seat extends angularly inwardly and is circumferentially continuous, the seat being conical and extending to the top of the upper portion 6. The seat has a diameter substantially the same as that of the inside of the wall portion and the inside of the bottle neck 2. This vent valve seat has a large diameter as compared to the diameter of the dispensing valve as a whole.

The cap forms a depending cylindrical flange 9 which surrounds and is connected to the upper portion 6 of the wall of the base. The cap has a closed top shown as being closed by an elastically flexible diaphragm 10, having a central dispensing hole 11. The self-closing valve construction normally closing the dispensing hole 11 and which opens only when the bottle is collapsed by squeezing is described in detail hereinafter. It is sufficient to note at this time that this self-closing valve provides a positive shut-off requiring the dispensing valve to vent when necessary.

Internally, the cap integrally forms a circular elastic vent valve 12 extending angularly inwardly and with an outside seating on the inside of the seat 8. This vent valve 12 normally presses elastically but tightly against the seat 8 of the base while being rotatively slidable on this seat. As shown by FIG. 2, the dispensing valve forms a venting passageway 13 between at least a portion of the outside of the vent valve and the outside of the dispensing valve. When the internal pressure within the dispensing valve is below atmospheric pressure air forces through the passageway 13 and is applied against the outside of the vent valve and the latter is displaced inwardly and venting occurs.

The upper portion 6 of the base has a flange 14 extending radially outwardly from the valve seat of the base. The cap's depending flange 9 has a circular inwardly extending lip 15 fitting under the flange 14. The outside of the flange 14 and the inside of the cap's flange 9 have interfitting conical surfaces so the cap and base can be assembled by pushing the cap onto the base. The cap's lip 15 snaps under the base's connection flange 14. These interfitting parts firmly pressed together on the cap can be rotated on the base, the interfitting surfaces sliding on each other. The conical surfaces of the cap and base intermate. When the two parts are pushed together, the depending flange of the cap is wedged elastially outwardly until the lip 15 snaps under the connecting flange 14 of the base.

The conical vent valve of the base extends completely to the top of the base's upper wall portion 6, and the vent valve of the cap completely overlaps the seat's surface. The passageway 13 is formed by the connection flange 14 having one or more discontinuities or spaces as shown at 15 in FIG. 5. The bottom rim of the cap is spaced slightly from the top of the lower portion of the wall of the base, as indicated at 16 while the lip 15 of the cap's flange is radially spaced as at 17 from the upper portion of the base's wall so that a passageway extends from the outside of the dispensing valve to one or more of localized portions of the vent valve.

The self-closing valve construction uses the principles of the valve disclosed by the Laauwe U.S. Pat. No. 4,226,343 but differs in that in this instance the valve can be locked closed by rotating the cap on the base of the new valve, eliminating the need for the inner seal used by this patented valve.

In this instance, the wafer 18 is formed with an integral depending cup 19 forming a mouth 20. This mouth forms one element of a bayonet joint, as shown in detail by FIG. 5. This cup is immovable mounted by the spokes 21 having their outer ends integrally joined with the uoper portion 6 of the base. The tips of the spokes are an integral part of the wafer 18 and cap 19, and the spokes provide abutments 22 for preventing excessive downward motion of the diaphragm 10. The periphery of the diaphragm hole 11 and the periphery of the wafer 18 form conical inter-mating surfaces as described by the Laauwe patent, so that the valve provides for a positive shut-off.

The diaphragm 10 around the dispending hole 11 forms four small spokes 23 which extend diagonally inwardly over the dispensing hole 11. These small spokes form a bracket from which male element 24 of the bayonet joint depends into the mouth 20 of the cup 19. This male element 24 therefore moves thereafter with the movement of the diaphragm 10 and rotates when the cap 9 is rotated. When the cap is rotated to unlock the male element, the latter can move freely up and down with the diaphragm as shown by FIG. 3. In this figure, the extend of the motion is greatly exaggerated by illustrious purooses. When the cap is rotated to lock the bayonet joint, the male element lips 25 fit under the lips 26 of the female element formed by the mouth of the cup 19. When locked, the diaphgram 10 is held downwardly with the periphery of the dispensing hole placed on the abutments 22 and with the conical surfaced of the dispensing hole's periphery and the periphery of the wafer 18 pressed firmly together. The cap can be marked with indicia to indicate its off and on positions.

To limit rotation of the cap to the two positions, the bottom of the lower rim can be formed with arcuate slots 26 into which fit abutments 27 upstanding from the base's ledge formed by the top of the lower portion 1 of the base.

The cap can have its outer periphery serated as indicated at 28 in FIG. 4 to make its turning easier.

The vent valve construction by itself does not require this locking feature to be effective.

What is claimed is:

1. A dispensing device for a squeeze bottle having a cylindrical neck, the device comprising a base forming a cylindrical wall having a lower portion internally reduced in thickness and fitting over said neck and an upper portion externally reduced in thickness and forming an internally beveled and continuously circular rim forming a vent valve seat; said dispensing device having a cap forming a depending cylindrical flange surrounding and connected to said upper portion, said cap having a closed top having a central dispensing hole, said flange having a continuously circular elastic vent valve with an inverted conical shape extending angularly inwardly with an outside seating on said vent valve seat, said dispensing device having a venting passageway extending between a portion of the outside of said vent valve and the outside of said dispensing device between the base and the cap, said vent valve seat extending to the top of the base's said upper portion and the ouside of said vent valve completely overlapping the seat, said venting passageway further comprising at least one radially extending slot opening through the seat to the outside of the device, said cap being rotative on said base and said vent valve being rotatively slidable on said vent valve seat, said upper portion of the base's said cylindrical wall having a connection flange extending outwardly radially from said valve seat, and the cap's said depending flange having a circular inwardly extending lip snapped under said connection flange, said connection flange and said lip having intermating conical surfaces causing said depending flange of said cap to be wedged outwardly with said lip snapping under said connection flange when said cap and said base are pushed together to assemble said dispensing device, said closed top of said cap being in the form of a flexible diaphragm and said base having radially inwardly extending spokes having tips on which an annular valve head is supported, said central dispensing hole and said annular valve head forming a self closing valve having inter-mating conical surfaces and the diaphragm normally elastically pressing said surfaces together, whereby internal pressure on the inside of said diaphragm, produced by collapsing said bottle, forces said diaphragm upwardly and separates said surfaces so as to open said dispensing hole, said device having an inverted cup supported by said spokes and having a wall depending from said annular valve head and a mouth forming a female element of a bayonet joint; and the outside of said diaphragm being fixed to a bracket from which a male element of said joint depends into said mouth, rotation of said cap on said base causing said joint to connect and disconnect and when connected holding said diaphragm downwardly with said intermating conical surfaces of said hole and said annular valve head forced together.

* * * * *